United States Patent [19]

McAllister et al.

[11] Patent Number: 4,821,364

[45] Date of Patent: Apr. 18, 1989

[54] FLUID CONTROL VALVE

[75] Inventors: Tom A. McAllister, Mississauga; John S. McAllister, Pickering; William R. Bonnar, Whitby, all of Canada

[73] Assignee: American Home Products Corporation, New York, N.Y.

[21] Appl. No.: 187,371

[22] Filed: Apr. 28, 1988

[30] Foreign Application Priority Data

May 5, 1987 [CA] Canada ..... 536382

[51] Int. Cl.[4] ..... A47L 7/00

[52] U.S. Cl. ..... 15/322; 15/321; 251/339; 251/354

[58] Field of Search ..... 15/321, 322; 251/339, 251/347, 348, 354

[56] References Cited

U.S. PATENT DOCUMENTS 2,842,337 7/1958 Pintarelli ..... 251/339
2,892,574 6/1959 Noe ..... 251/354 X
3,818,538 6/1974 Kraft ..... 15/322
4,052,767 10/1977 Datcher ..... 15/410 X
4,074,387 2/1978 Avato et al. ..... 15/322

*Primary Examiner*—Chris K. Moore
*Attorney, Agent, or Firm*—Darby & Darby

[57] ABSTRACT

A fluid control valve includes a deformable conduit for fluid with a valve control port at a point of fluid entry to the conduit. The valve control port includes a spring-biased device for keeping the port closed to fluid in an unactuated valve state. A support element is disposed within the conduit downstream of the valve control port. The support element also permits fluid flow therethrough. A trigger mechanism is disposed within the conduit between the valve control port and the support element; the mechanism includes an elongated bar having a deformable irregularity. The bar extends from the support element to the port closing device, with the end of the bar contacting the port closing device with a low level of force in an unactuated state of the valve. The irregularity is subject to being deformed by external pressure applied through the conduit for actuating the valve by causing the bar to straighten so as to apply sufficient force to the port closing device to overcome the applied bias in order to open the port to fluid.

8 Claims, 1 Drawing Sheet

FLUID CONTROL VALVE

BACKGROUND OF THE INVENTION

The present invention relates to a fluid control valve and, more particularly, to a fluid control valve having a trigger mechanism internal to a fluid conduit. A particular application for such a valve is for the control of liquid flow to a spray-type vacuum cleaner nozzle.

Known arrangements of fluid control valves include devices having a control element which protrudes from the valve itself for actuation by a user. A device of this type is shown in FIG. 7 of Canadian Patent 1,087,814. In this arrangement, liquid is conducted through a hose element which is controlled by a valve having a protruding pushbutton 76 at the end of a pushrod 77. This valve also includes a displacement of the liquid path from input to output causing the overall valve height to be rather substantial, making the valve control difficult to handle by the user. The location of pushbutton 76 also does not easily accommodate the human hand.

Another type of valve which is commercially available includes a fluid control element which is placed internal to a fluid conduit. In this type of arrangement, the end of an elongated lever within the conduit must be moved a considerable distance to cause a valve closing element to be displaced from a valve seat in order to have flow of fluid through the valve Such valves have been used in spray guns but have limited application in other environments requiring a relatively small movement of a hand-controlled trigger mechanism for controlling fluid flow.

SUMMARY OF THE INVENTION

It is an object of the present invention to provide a fluid control valve which overcomes the various deficiencies of prior art fluid control valves.

It is another object of the present invention to provide a fluid control valve which is relatively compact in design and which has all controlling elements disposed within the path of fluid.

It is a further object of the present invention to provide a fluid control valve having the fluid conduit and valve control readily holdable in one hand of the user wherein the valve control is effected by slight movement and pressure of one or two figures of the hand of the user.

It is yet another object of the present invention to provide an improved fluid control valve for use in a spray-type vacuum cleaning nozzle.

In accordance with the present invention, a fluid control valve comprise a deformable conduit for fluid and a valve control port connected to the conduit at a fluid entry point of the conduit; the port includes means biased to keep the port closed to fluid in an unactuated valve state. A support element is disposed within the conduit downstream of the valve control port; the support element also permits fluid flow therethrough. A trigger mechanism is disposed within the conduit between the valve control port and the support element. The mechanism includes an elongated bar having a deformable irregularity. The bar extends from the support element to the port closing means. The end of the bar contacts the port closing means with a low level of force in an unactuated state of the valve. The irregularity is subject to being deformed by external pressure applied through the conduit for actuating the valve by causing the bar to straighten so as to apply sufficient force to the port closing means to overcome the applied bias in order to open said port to fluid.

For a better understanding of the present invention, reference is made to the following description and accompanying drawings, while the scope of the present invention will be pointed out in the appended claims.

DESCRIPTION OF THE PREFERRED EMBODIMENTS

Figures 1, 2, 3:
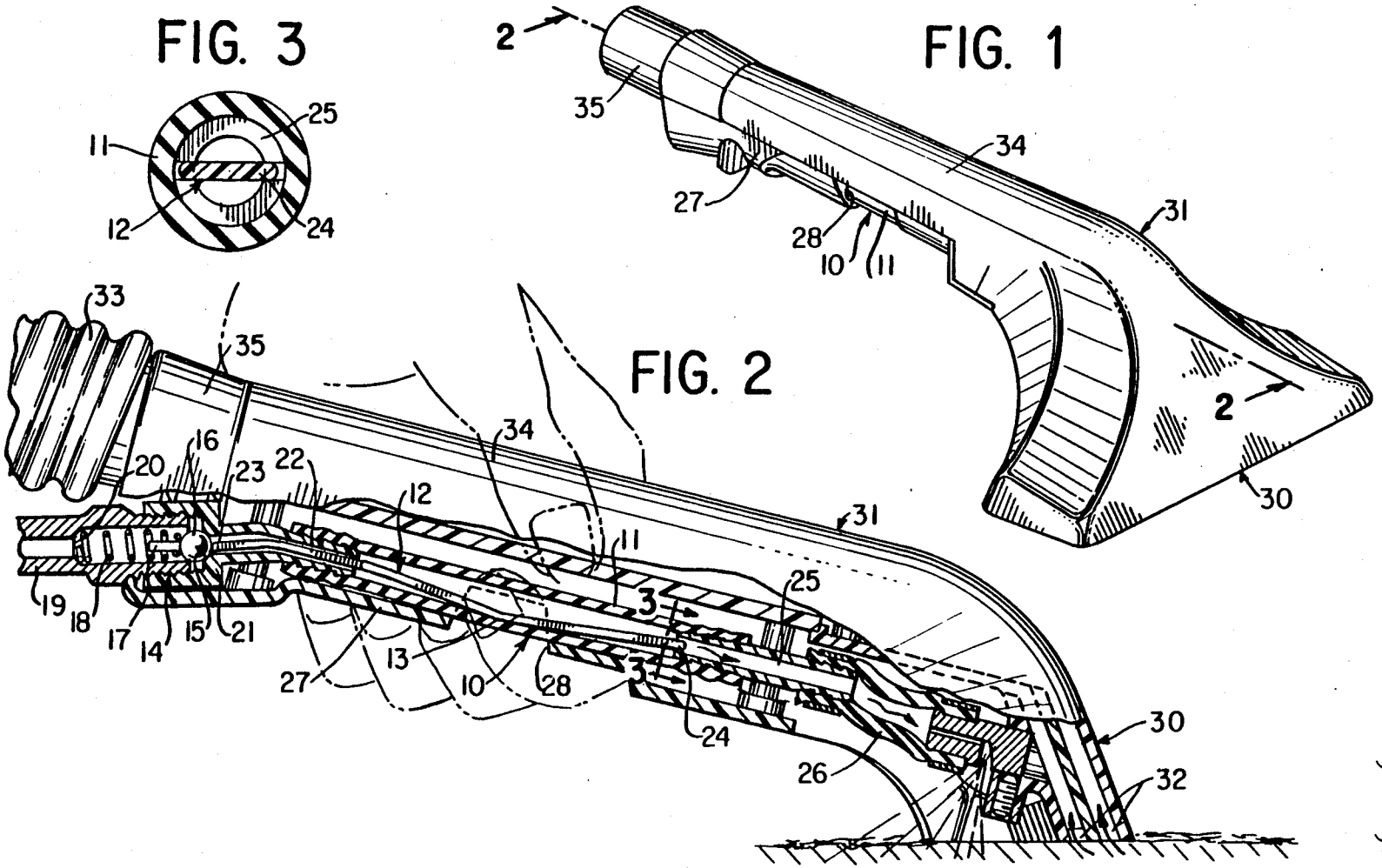
FIG. 1 is a perspective view of a nozzle for a spray-type vacuum cleaner employing a fluid control valve in accordance with the present invention.
FIG. 2 is a side view of the nozzle of FIG. 1 with a partially broken away sectional view along line 2—2 of FIG. 1 illustrating the fluid control valve of the present invention.
FIG. 3 is a sectional view along line 3—3 of FIG. 2 showing the support arrangement for the trigger mechanism of the fluid control valve of the present invention.

The nozzle 31 shown in FIGS. 1 and 2 is of the kind employed with spray-type vacuum cleaning apparatus. In such apparatus, a spray of cleaning liquid is imparted to an object to be cleaned through such a nozzle (typically furniture or a carpet) and, at the same time, a vacuum is applied through the nozzle to suck up the applied liquid together with removed dirt. A fluid control valve is employed so that the user may apply the cleaning liquid upon demand. Such a fluid control valve is shown as 10 in FIG. 2.

The fluid control valve 10 includes a trigger mechanism 12, a valve control port 14 and a support element or fitting 25. The trigger mechanism is disposed within a deformable conduit 11, typically a plastic tube. The trigger mechanism 12 is typically constructed as an elongated deformable bar.

The valve control port 14 is connected to an inlet pipe 19 for the supply of fluid. For the cleaning application referred to, this fluid is a cleaning liquid or solution. The inlet pipe 19 includes a portion for receiving a spring 18; the spring 18 presses at one end against a seat 20 in the inlet pipe. A ball 16 is inserted in the other end of the spring by way of a projection 17 affixed to the ball. In an unactuated state of the valve, the spring 18 forces the ball against a valve opening 15 located in a valve seat 21 to keep the valve control port closed.

The valve seat 21 has a narrow pipe 22 extending therefrom for connection to one end of the conduit 11. The other end of conduit 11 extends to the support element 25 from which conduit outlet pipe 26 extends. The end of the trigger mechanism adjacent the valve control port 14 is a valve actuation portion 23 of trigger mechanism 12. This element lightly contacts the ball 16 in an unactuated valve state. The other end of the trigger mechanism 12 is the trigger mechanism support end 24 which rests against and is supported by support element 25. This construction is shown more clearly in FIG. 3.

The deformable bar of said trigger mechanism 12 includes an irregularity 13. The irregularity 13 is exposed to outside pressure through the walls of the deformable conduit 11 at a trigger control opening 28 in the lower casing 27 of the nozzle.

The valve 10 is actuated by finger pressure against deformable irregularity 13. This causes the trigger mechanism 12 to straighten by deformation which, in turn, causes the valve actuation element 23 to apply sufficient force against ball 16 to overcome the bias supplied by the spring 18 so as to open the valve control port 14. In so doing, the deformation of the irregularity causes the linear end-to-end distance of the trigger mechanism to increase.

The conduit outlet pipe 26 is connected to a spray head 30 in order to apply a spray of liquid when the fluid control valve 10 is actuated. The nozzle 31 also includes vacuum inlets 32 for drawing the dirt-laden liquid into the nozzle and then into hose 33 at nozzle end 35 for connection to a vacuum source (not shown).

It should be noted that the trigger control opening 28 is actually a part of the nozzle handle 34, ordinarily held by the user, which makes for easy and efficient user operation.

While the principle embodiment relates to a fluid control valve for dispensing a liquid, the same principle and general structure may be used to control the flow of a gas.

Similarly, while the trigger mechanism has been described in terms of a single bar with a deformable irregularity, other arrangements may readily come to mind to one of ordinary skill to achieve the required increase in straight-line, end-to-end distance of the trigger mechanism in response to external manual pressure applied to the conduit.

While the foregoing description and drawings represent the preferred embodiments of the present invention, it will be obvious to those skilled in the art that various changes and modifications may be made therein without departing from the true spirit and scope of the claims.

What is claimed is:

1. A fluid control valve comprising:

a deformable conduit for fluid;

a valve control port connected to said conduit at a fluid entry point of said conduit, said port including means biased to keep said port closed to fluid in an unactuated valve state;

a support element disposed within said conduit downstream of said valve control port, said support element also permitting fluid flow therethrough;

a trigger mechanism disposed within said conduit between said valve control port and said support element, said mechanism including an elongated bar having a deformable irregularity, said bar extending from said support element to said port closing means, the end of said bar contacting said port closing means with a low level of force in an unactuated state of said valve; and said irregularity subject to being deformed by external pressure applied through said conduit for actuating said valve by causing said bar to straighten so as to apply sufficient force to said port closing means to overcome the applied bias in order to open said port to fluid.

2. The fluid control valve of claim 1, wherein said port closing means is a ball and the bias in said port closing means is applied to said ball by a spring.

3. The fluid control valve of claim 2, wherein said port closing means include an inlet pipe, a spring being inserted in said pipe, an internal portion of said pipe forming a seat for said spring, said ball having a protrusion for insertion in an end of said spring.

4. The fluid control valve of claim 3, including a valve seat, said valve seat having a valve opening therein, said valve opening having an inlet side and an outlet side, said ball being disposed said opening on the inlet side and being biased by said spring to keep said valve opening closed in an unactuated state of said valve, said outlet side of said valve opening connected to said conduit by a pipe.

5. The fluid control valve of claim 1, wherein said bar is a flexible plastic bar, said bar capable of returning to an original shape after being deformed.

6. A cleaning device for a vacuum, spray-type cleaning apparatus comprising:

a hose for providing a vacuum;

means for supply a source of liquid;

a valve for controlling the flow of liquid from said liquid supply means, said valve including:

a deformable conduit for liquid;

a valve control port connected to said conduit at a liquid entry point of said conduit, said port including means biased to keep said port closed to liquid in an unactuated valve state;

a support element disposed within said conduit downstream of said valve control port, said support element also permitting liquid flow therethrough;

a trigger mechanism disposed within said conduit between said valve control port and said support element, said mechanism including an elongated bar having a deformable irregularity, said bar extending from said support element to said port closing means, the end of said bar contacting said port closing means with a low level of force in an unactuated state of said valve;

said irregularity subject to being deformed by external pressure applied through said conduit for actuating said valve by causing the length of said bar to increase so as to apply sufficient force to said port closing means to overcome the applied bias in order to open said port to liquid; and a nozzle connected to said hose and valve for supplying a liquid and a vacuum to an item to be cleaned.

7. A fluid control valve comprising:

a deformable conduit for fluid;

a valve control port connected to said conduit at a fluid entry point of said conduit, said port including means biased to keep said port closed to fluid in an unactuated valve state;

a support element disposed within said conduit downstream of said valve control port, said support element also permitting fluid flow therethrough;

a trigger mechanism disposed within said conduit between said valve control port and said support element, said mechanism having a part with a first length as measured along a straight line from one end of said part to the other in an unactuated state of said valve and having a second length as measured in a straight line from one end of said part to the other in an actuated state of said valve wherein said second length is greater than said first length; and means disposed within said conduit and being subject to pressure applied through said conduit for causing said part to change from said first length to said second length, wherein when said trigger mechanism part has its second length, the part applies sufficient force to said port closing means to overcome the applied bias in order to open said port to fluid, said part applying insufficient force to said port closing means to overcome the applied bias when said part has its first length.

8. The fluid control valve of claim 1 wherein said bar is composed of flexible material, said bar capable of returning to an original shape after being deformed.

* * * * *